United States Patent [19]

Pinson

[11] Patent Number: 5,056,406

[45] Date of Patent: Oct. 15, 1991

[54] FIBER OPTIC MORTAR PROJECTILE

[75] Inventor: George T. Pinson, Huntsville, Ala.

[73] Assignee: The Boeing Company, Seattle, Wash.

[21] Appl. No.: 493,817

[22] Filed: Mar. 15, 1990

[51] Int. Cl.[5] ..... F42B 14/00; F42B 15/04

[52] U.S. Cl. ..... 89/1.816; 102/532; 244/3.12

[58] Field of Search ..... 89/1.816; 244/3.12; 102/372, 373, 479, 503, 520, 532

[56] References Cited

U.S. PATENT DOCUMENTS

| | | | |
|---|---|---|---|
| 384,574 | 6/1888 | Hawley | 102/520 |
| 1,322,601 | 11/1919 | Newlander | 89/1.34 |
| 1,861,522 | 6/1921 | Brandt | 102/524 |
| 3,069,975 | 12/1962 | Nauschutz et al. | 244/3.12 |
| 3,358,559 | 12/1967 | Grandy | 244/3.12 |
| 3,548,708 | 12/1970 | Hubigh | 89/1.818 |
| 3,583,277 | 6/1971 | Crockett | 89/1.8 |
| 3,687,079 | 8/1972 | Scollins | 102/524 |
| 4,185,796 | 1/1980 | Riley | 244/3.12 |
| 4,515,082 | 5/1985 | Pizzurro | 102/532 |
| 4,573,647 | 3/1986 | Laten et al. | 244/3.12 |
| 4,665,825 | 5/1987 | Pettersson | 102/372 |
| 4,746,080 | 5/1988 | Pinson | 242/177 |
| 4,770,370 | 9/1988 | Pinson | 244/3.12 |
| 4,796,510 | 1/1989 | Piesik | 89/1.816 |
| 4,796,833 | 1/1989 | Pinson | 244/3.12 |
| 4,860,968 | 8/1989 | Pinson | 244/3.12 |

*Primary Examiner*—Charles T. Jordan

*Attorney, Agent, or Firm*—Finnegan, Henderson, Farabow, Garrett & Dunner

[57] ABSTRACT

Improvements to a fiber optically guided projectile include an obturator with a groove formed in the outer wall. An obturator ring is placed in the groove. The ring is made of resilient material, has a relaxed diameter greater than the bottom of the groove and is split so that it is releasable from the groove. Additionally, the rearmost wall of the groove is tapered to aid in the release, and the section of the obturator forward of the groove has a larger diameter than the section aft of the groove. A curved groove acts to transition the fiber from a longitudinal to a substantially tangential direction. Furthermore, either a cone or sleeve extension is included to prevent the fiber from looping about the projectile. An ejectable aft closure plate is provided to seal the interior of the projectile during launch.

9 Claims, 4 Drawing Sheets

FIBER OPTIC MORTAR PROJECTILE

BACKGROUND OF THE INVENTION

1. Field of the Invention

This invention relates to an optical fiber guided projectile system particularly a tube-launched projectile system.

2. Description of the Related Art

This application is directed to an improvement of my inventions described in U.S. Pat. Nos. 4,770,374 and 4,796,833, which are specifically incorporated by reference for the purpose of providing a description of related art and background information on the function and operation of the projectile system improved by the invention of the application.

The basic elements of the projectile system provide for a groove placed in the projectile airframe. An optical fiber is placed in the groove. The projectile is fired in a conventional manner. During launch, the fiber is pulled from the groove and then deployed from a fiber holding bobbin at the rear of the projectile.

The projectile is dropped into a mortar by the soldier in a random axially-rotated orientation. At the prelaunch condition, the fiber exits the tube parallel or with a slight bow relative to the wall of the tube. The projectile is initially some 18 or so inches behind the tube exit. After ignition of the propellant charge, the projectile begins to move out of the mortar tube. As the projectile moves, the fiber not being a rigid body, remains basically in its original position external to the mortar. Inside the tube, however, the fiber buckles and collapses around the projectile. As the projectile exits the tube, the projectile has, in general, passed through the loop formed by the fiber. The fiber is wrapped around the projectile. At this point it makes little difference whether the fiber is wrapped around the projectile in a clockwise or counterclockwise direction.

As the projectile exits the mortar tube, the fiber is pulled out of the groove. Damage may be caused to the fiber if pulled out of the groove so that it bends around the end of the projectile, or if the launch process too abruptly begins to remove fiber from the bobbin. The damage is typically caused by a too abrupt change in fiber direction or other cause of a sharp bend in the fiber. Additionally, the projectile system exhibits the problem of hot launch gas blow-by while the projectile is in the mortar tube.

The objects and advantages of the invention in part will be apparent from the description which follows.

SUMMARY OF THE INVENTION

The subject invention provides an optical fiber guided projectile system wherein the projectile, to be fired from a tubular launcher is provided with obturator means for preventing gas blow-by, improved fiber transition to pay-out, means for preventing looping of the optical fiber, and for aft closure means.

In accordance with a first feature of the invention, as embodied and broadly described herein, in an optical fiber pay-out system for a tube-launched projectile of the type having a propellant charge located at the rear end for launching the projectile and an unwound end of the optical fiber deployed out the forward end of the launch tube prior to launch, a first improvement comprises obturator means for protecting the optical fiber against the launch gases, the obturator means having means for receiving an obturator ring wherein the obturator means comprises an obturator body having a circumferential groove formed therein and fixed to the aft end of the projectile, an obturator ring disposed in the groove, and means for releasing the ring from the groove for enabling a smooth transition to fiber pay-out.

In accordance with a preferred embodiment the present invention, in which the optical fiber wound on a pay-out bobbin is mounted adjacent the rear of the projectile, and a longitudinal groove extends toward the front of the missile and is formed in the outside of the projectile casing for holding the unwound end of the optical fiber during launch, the obturator preferably includes a polished and tapered trailing end portion for assisting in smooth fiber deployment, and the ring releasing means includes the rearmost sidewall of the groove axially tapered, the obturator body having a reduced diameter aft of the groove, and the ring having a gap or slit and comprising resilient material which in a relaxed state has an inner diameter greater than the bottom of the groove.

In accordance with a second feature of the invention, as embodied and broadly described herein, a second improvement comprises transition means holding the portion of the fiber unwound end between the wound bobbin and the rearmost portion of the longitudinal groove.

In accordance with a preferred embodiment of the present invention, the transition means preferably includes a curved groove longitudinally oriented at the forward end and oriented tangentially to the diameter of the bobbin at the aft end.

In accordance with a third feature of the invention, as embodied and broadly described herein, a third improvement comprises means associated with the projectile for preventing looping of the deployed unwound optical fiber around the projectile during launch.

In accordance with a preferred embodiment of the present invention, the means for preventing looping preferably includes either a nose cone having an axially extended and tapered profile, or an extendable sleeve assembly for holding the optical fiber.

In accordance with a fourth feature of the invention, as embodied and broadly described herein, a fourth improvement comprises an aft closure including a solid closure plate with attaching means for connecting the plate to the projectile and detaching means for releasing the attaching means after launch of the projectile.

In accordance with a preferred embodiment of the present invention, the aft closure attaching and detaching means preferably includes either shear pins which shear under the force of expanding launch gases, or pyrotechnic bolts which shear from the nuts after launch.

In accordance with a preferred embodiment of the present invention, the aft closure includes means for ejecting the aft closure plate. Preferably, the ejecting means includes a spring.

The invention resides in the novel parts, construction, arrangements, combinations and improvements shown and described. The accompanying drawings, which are incorporated in and constitute a part of this specification, illustrate the presently preferred embodiments of the invention and, together with the description, serve to explain the principles of the invention.

BRIEF DESCRIPTION OF THE DRAWINGS

FIG. 2(*b*) includes full front and side views of the obturator ring.

FIG. 4(*b*) is a cross-sectional view of the projectile body and longitudinal groove.

FIG. 13(*b*) is a graphical representation of the aft closure during launch.

DETAILED DESCRIPTION OF THE PREFERRED EMBODIMENTS

Reference will now be made in detail to the presently preferred embodiments of the invention, an example of each is illustrated in the accompanying drawings.

Figure 1:
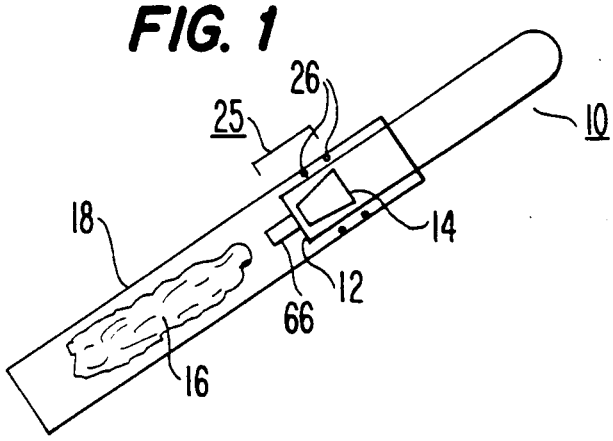
FIG. 1 is a pictorial representation of the projectile leaving the launch tube.
Figure 2A:
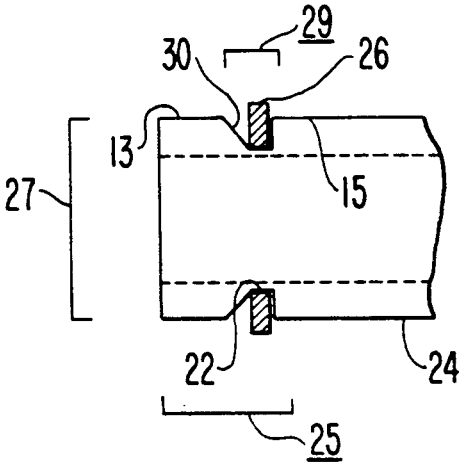
FIG. 2(*a*) is a cross-sectional view of the obturator body.
Figure 2B:
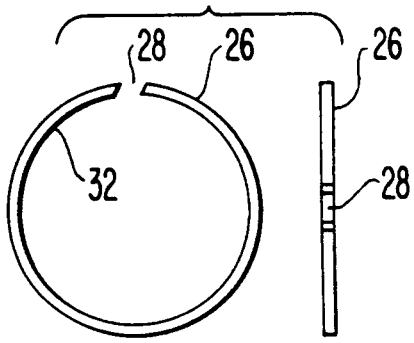
Figure 3A:
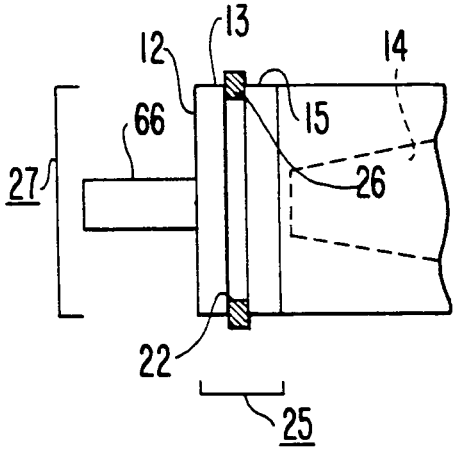
FIGS. 3(*a*) and (*b*) are side views of alternate embodiments for the placement of the obturator ring on the projectile.
Figure 3B:
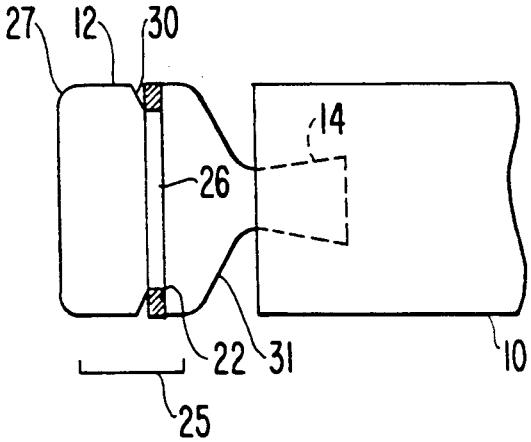
Figure 4A:
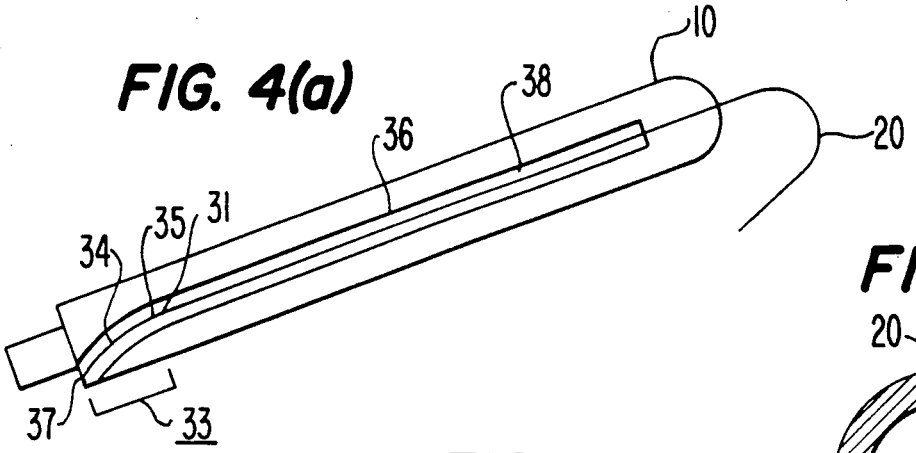
FIG. 4(*a*) is a pictorial representation of the longitudinal groove.
Figure 4B:
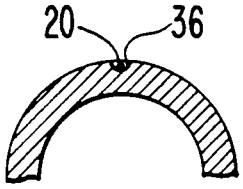
Figure 5:
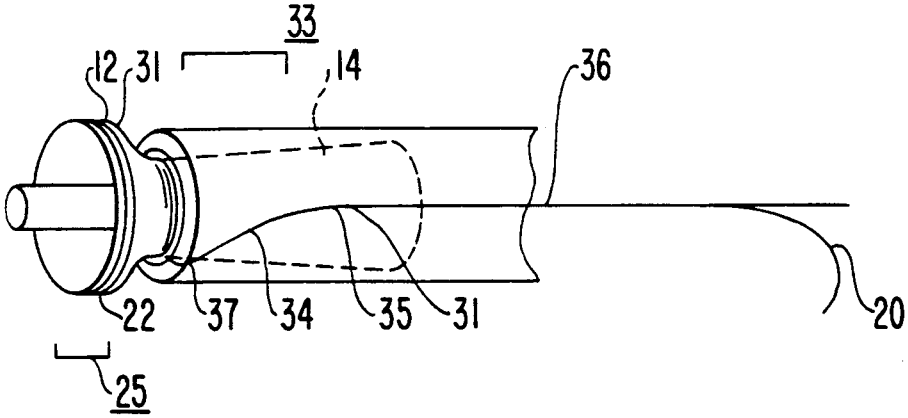
FIG. 5 is a pictorial representation of the fiber transition means and the tapered obturator body.
Figure 6A:
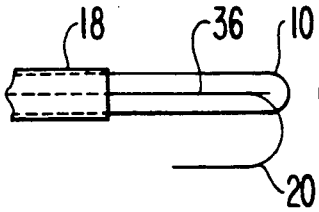
FIGS. 6(*a*), (*b*) and (*c*) are sequential views depicting the optical fiber removal from the groove and transition during projectile launch.
Figure 6B:
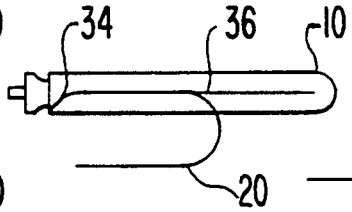
Figure 6C:
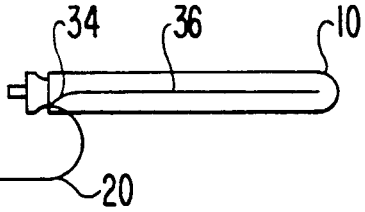
Figure 7A:
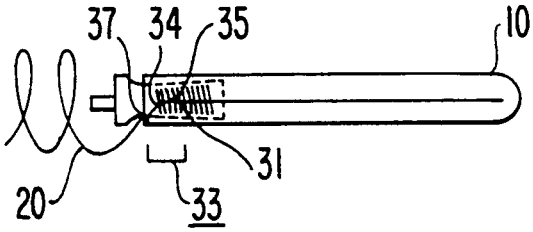
FIGS. 7(*a*) and (*b*) depict the fiber transition and pay-out after projectile launch.
Figure 7B:
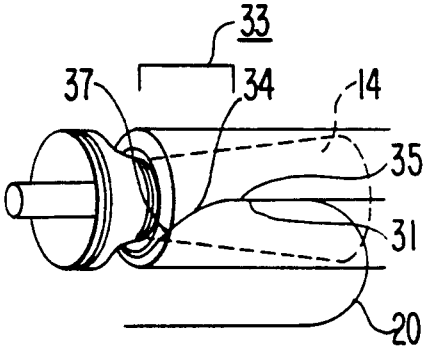

In accordance with the present invention, the first improvement to the projectile system comprises obturator means including an obturator ring, and means for releasing the ring following projectile launch. As embodied herein, and as shown in FIGS. 1–3, obturator means 25 includes obturator body 12 with an axis and axisymetric expanded portion 27 sized for sliding clearance with the inside surface of launch tube 18, means for receiving an obturator ring 26 including a circumferential groove 22 formed therein, one or more obturator rings 26 disposed in such groove 22, and releasing means 29 for the ring. Further preferred constructions (FIGS. 2 and 5) include obturator body 12 with a polished and tapered trailing end portion 27 and with a forward end taper 31 preferably tapered at approximately 40° to 45° (as shown in FIG. 3(*b*)), ring 26 including gap or slit 28 (as shown in FIG. 2(*b*)), and releasing means including obturator body 12 portion 13 rearward of groove 22 having a reduced diameter compared to portion 15 forward of groove 22, circumferential groove 22 having an axially tapered rear-most sidewall 30, and ring 26 constructed of resilient material (e.g., nylon) which in a relaxed state has an inner diameter 32 greater than the diameter of the bottom of groove 22.

Obturator means 25 is assembled so as to protect the wound bobbin 14 and the unwound optical fiber portion 20 (see FIG. 3(*b*)) from the expanding launch gases 16 inside of tube 18 caused by propellant charge attached to sting 66. Obturator body 12 with the polished and trailing end portion having taper 31 (shown in FIG. 3(*b*)) assists in smooth pay-out of optical fiber 20 after launch. The preferable forward end taper 31 is 40° to 45° which minimizes stress on the fiber, aerodynamic drag, and restricts flow separation when the fiber pays out. Rings 26 fit into groove 22 so that the resultant obturator means 25 is configured with sliding engagement with the inner wall of the launch tube 18 so that projectile 10 can slide into tube 18. Gap 28 of ring 26 allows air to pass ring 26 and therefore allows projectile 10 to slide into tube 18 without compressing the air in the tube. Ring 26 is preferably placed in groove 22 so that gap 28 is oriented 45° from the position of the fiber holding groove. In order to prevent launch gases 16 from escaping from tube 18 past projectile 10 upon launch, multiple rings 26 each with a gap 28 may be used to provide a torturous path for rapidly expanding launch gases 18 to follow.

The resultant obturator means 25 functions when projectile 10 is dropped down launch tube 18. Propellant charge attached to sting 66 is ignited causing the rapid expansion of exhaust gases 16. Gases 16 act on obturator body 12 and rings 26 to force projectile 10 from the launch tube. After projectile 10 leaves launch tube 18, aerodynamic drag moves ring 26 up rear groove wall taper 30 formed on obturator body 12 so that ring 26 falls away from the projectile 10.

In accordance with the present invention, the second improvement comprises transition means for holding the unwound portion of the optical fiber adjacent the wound bobbin and for releasing the optical fiber portion during launch. As embodied herein and shown in FIGS. 4–7, transition means 33 includes a curved groove 34 wherein the forward end 35 is substantially longitudinally oriented and connected to the longitudinal groove 36 and the rearward end 37 of groove 34 is substantially tangential to the circumference of the projectile 10 and adjacent to the wound bobbin 14. The transition means 33, including curved groove 34, holds a portion of the unwound end of the fiber between the wound bobbin 14 and the rearmost portion 31 of the longitudinal groove 36. 1–2 mil thick tape 38 covering groove 36 and groove 34 may be used to hold fiber 20 in place until projectile 10 leaves the launch tube. The tear strength of the tape 38 must be substantially less than the tensile strength of fiber 20.

The process of fiber peelout, or pay-out utilizing transition means 33, including curved groove 34, begins with the launch of projectile 10 after the propellant charge is ignited. Projectile 10 is ejected from launch tube 18 (FIG. 6(*a*)), then, as the projectile travels down range, tape 38 tears and fiber 20 is pulled from longitudinal groove 36 (FIG. 6(*b*)). Fiber 20 is then pulled from transition groove 34, and the direction of travel of fiber 20 relative to the projectile is changed gradually from substantially longitudinal to the axis of the projectile 10 to a combination of longitudinal to the axis and tangential to the circumference of the projectile (i.e., helical) (FIG. 6(*c*)). The force and bending of optical fiber 20 is thereby lessened when the fiber begins to pay-out from the bobbin 14 (FIG. 7(*a*)). The transition means allows less reinforced fiber to be wound on the bobbin compared with the prior art (approximately only one projectile length of reinforced fiber on the bobbin is required).

Figure 10A:
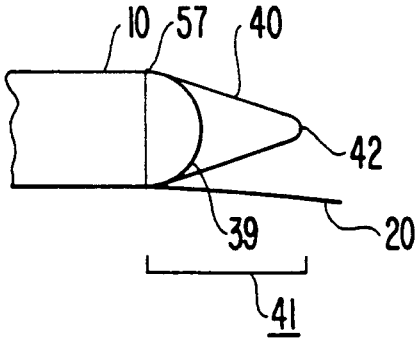
FIGS. 10(*a*) and (*b*) are graphical representations which depict the functioning of the extended nose cone.
Figure 10B:
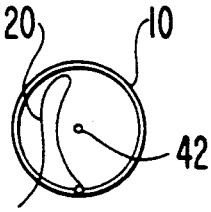
Figure 11:
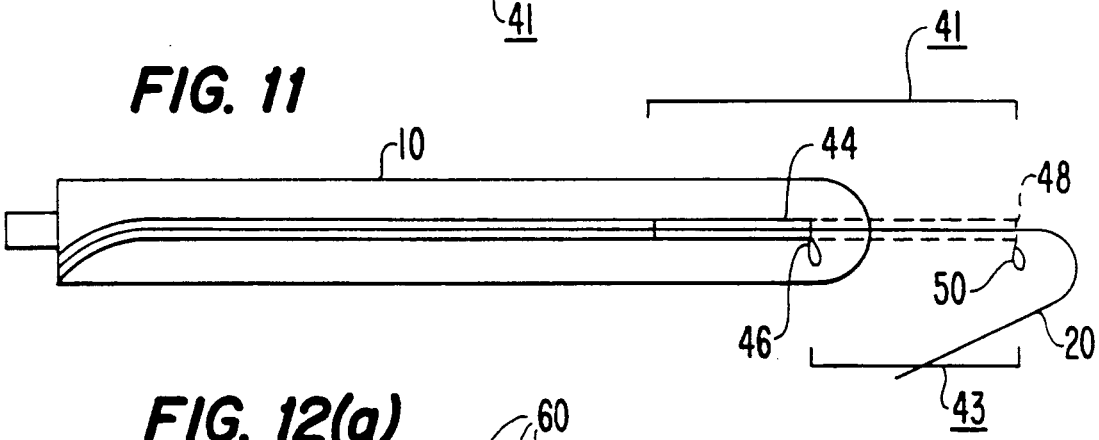
FIG. 11 is an idealized graphic representation of the extendable sleeve.
Figure 12A:
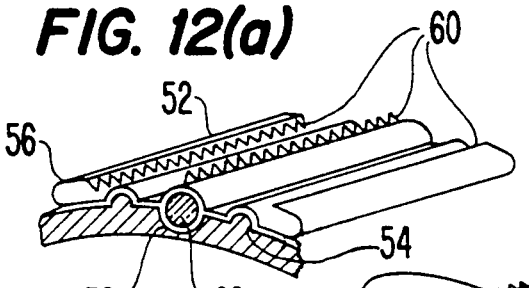
FIGS. 12(*a*) and (*b*) are pictorial representations which depict the female and male elements, respectively, of the slide mechanism for the extendable sleeve.
Figure 12B:
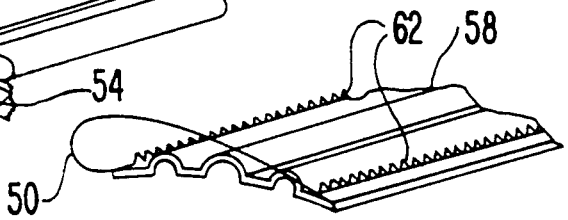

In accordance with the present invention, the third improvement comprises means associated with the projectile for preventing looping of the deployed unwound optical fiber end around the projectile during launch. As shown in FIGS. 10–12, and as preferably embodied herein, means 41 for preventing looping includes a nose cone 40 having an extended end 42. An alternative embodiment of the means for preventing looping includes a sleeve assembly 44 attached to projectile 10 with means 43 for loading the sleeve element 44 in extended position 48 which includes pull tab 50 for slidingly extending sleeve 44 from retracted position 46 to extended position 48. Loading means 43 and sleeve assembly 44 further includes female element 52, male element 58 and locking ratchet elements 60 and 62.

Figure 8A:
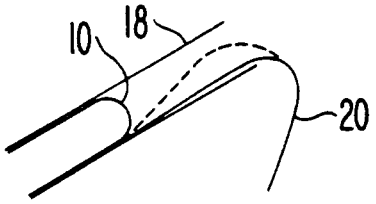
FIG. 8(a) (PRIOR ART)
FIGS. 8(*a*), (*b*) and (*c*) are side views of the optical fiber columnar collapse during projectile launch encountered in the prior art.
Figure 8B:
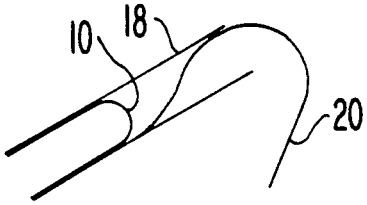
FIG. 8(b) (PRIOR ART)
Figure 8C:
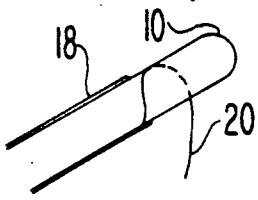
FIG. 8(c) (PRIOR ART)
Figure 9A:
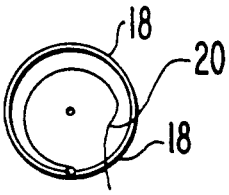
FIG. 9(a) (PRIOR ART)
FIGS. 9(*a*) and (*b*) are top views which depict the optical fiber columnar collapse during projectile launch encountered in the prior art.
Figure 9B:
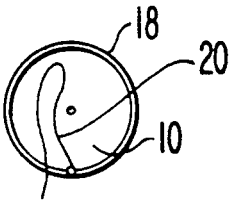
FIG. 9(b) (PRIOR ART)

Both the preferred and alternate embodiments of looping preventing means overcome the problems of looping optical fiber 20 around projectile 10 as the projectile leaves tube 18 as occurred in the prior art. FIG. 8 shows a cross-sectional view of the columnar collapse of the optical fiber 20 during launch as in the prior art, and FIG. 9 shows the possible paths of optical fiber 20 around the nose of projectile 10 during launch as in the prior art.

Preferred nose cone 40 has an end 42 which is extended so that upon launch the columnar collapse of optical fiber 20 is entirely to one side of end 42, thereby preventing fiber 20 from looping around projectile 10. Nose cone 40 which protects the optical dome 39 from damage by the user during unpacking and loading, is made in a conical shape. As the fiber collapses, motion of fiber 20 relative to the rapidly accelerating projectile 10 permits the fiber to uniformly collapse on one side of the center line of the projectile 10 thereby eliminating the fiber looping problem. The shape of the nose cone 40 which has an axially extended tapered profile can vary from a long probe to a more conical shape so long as the center line is significantly forward of the dome 39 contour. Nose cone 40 is discardable after launch. Preferably nose cone 40 is made of glass which can be shattered during flight by a solenoid valve and a plunger (not shown).

The alternative embodiment of looping preventing means is sleeve assembly 44 which is attached to projectile 10 and holds unwound end of optical fiber 20. Sleeve assembly 44 is slidingly extendable to a position adjacent to the launch tube 18 end. Sleeve assembly 44 is preferably made of light weight material such as carbon filament or fiber reinforced plastic tube.

Sleeve assembly 44 is fitted to projectile 10 rearward of the forward end of projectile 10 where the aerodynamic fairing of the projectile provides a reduced diameter 57, female element 52 is attached to the surface of the projectile with an adhesive that has a total peel strength of 10% or less than the breaking strength of the fiber 20. The fiber 20 is placed in groove 36, and parallel groove 54 in female element 52 together with flange 56 provides a positive track within which male element 58 rides. Element 58 is locked into place in the firing position 50 by locking ratchet elements 60 and 62 which prevent motion during the launch period. These elements are made of matching triangular sections that fit together when closed. As an alternate, a spring forced ratchet can be used. Once the sleeve is in the extended position 48, the projectile is conventionally loaded and fired. Upon exiting the launch tube 18 the fiber 20 peels the female element 52 away from the projectile and the fiber 20 is stripped from the groove in a conventional manner.

In accordance with the present invention, the fourth improvement comprises a solid aft closure plate. As embodied herein with reference to FIGS. 13 and 14, solid aft closure plate 64 has sufficient size to seal the aft end of the tube launched projectile. Further included are attaching means for connecting aft closure plate 64 to aft end of tube launched projectile 10 and detaching means for releasing the aft closure plate. Attaching means preferably includes shear pins 70, and detaching means preferably includes sliding means including recess 72 adapted to allow shear pins 70 to shear (FIGS. 13(*a*) and (*b*)). Alternatively, attaching means includes bolts 80 secured by nuts 82, and detaching means comprises stripping means including pyrotechnic charge 84, electrical connection means 88 and controller 86 (FIGS. 15(*a*) and (*b*)). Further preferably included is ejecting means which preferably includes spring 74.

Attaching means acting together with aft closure plate 64 protects the aft interior of the projectile 10 from expanding launch gases 16. Releasing means acting together with ejecting means provide jettisoning of aft closure plate 64 from projectile 10 after launch.

Figure 13A:
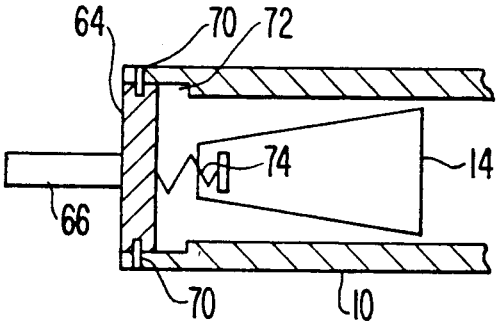
FIG. 13(*a*) is a graphical representation of the aft closure prior to launch.
Figure 13B:
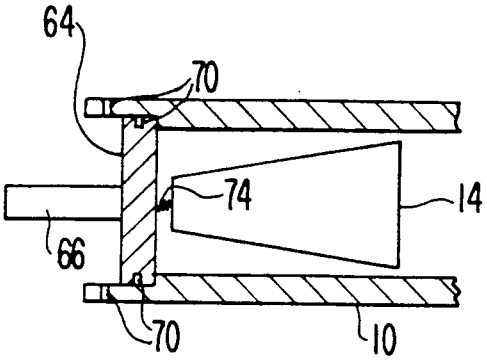

The preferred embodiment includes shear pins 70 passing through the projectile body 10 into plate 64. Recess 72 in the aft end of projectile 10 is provided with substantially the same diameter as the exterior diameter of plate 64. Recess 72 allows plate 64 to move forward under pressure from the launch gases 16. The forward movement of plate 64 results in shear pins 70 shearing as shown in FIG. 13(*b*). The attaching means are thus released after the launch of the projectile.

Figure 14A:
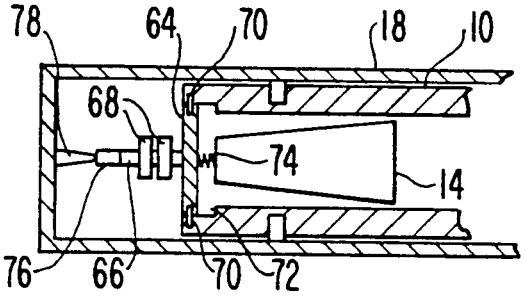
FIGS. 14(*a*) and (*b*) are distorted cross-sectional representations which depict the action of the aft closure during projectile launch.
Figure 14B:
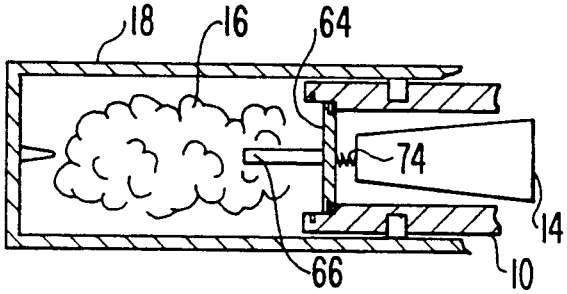

The preferred embodiment of the aft closure operates as shown in FIG. 14. Projectile 10 travels down launch tube 18 until cap 76 strikes pin 78. Propellant 68 is then ignited driving plate 64 forward in recess 72 as shown in FIG. 14(*b*). Shear pins 70 shear and spring 74 is compressed. Once the projectile 10 leaves tube 18, plate 64 is ejected by spring 74.

Figure 15A:
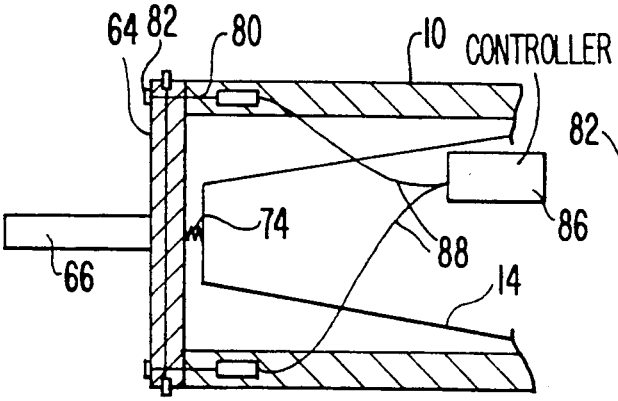
FIGS. 15(*a*) and (*b*) are graphical representations which depict the aft closure secured with pyrotechnic bolts.
Figure 15B:
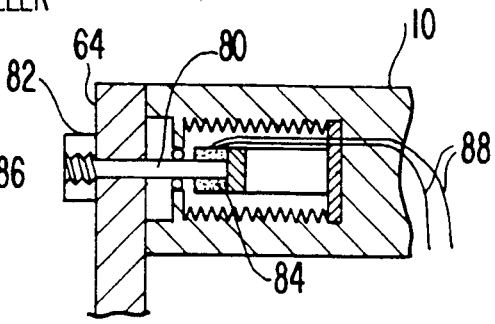

As alternatively embodied herein as shown in FIG. 15, bolts 80 are secured in projectile 10 and pass through plate 64 with nuts 82 attached to bolts 80. The releasing means includes a pyrotechnic charge 84 ignitable by a controller 86 through wires 88.

The alternative embodiment of the aft closure functions after projectile 10 leaves the launch tube. Controller 86 ignites pyrotechnic charge 84. The bolt is driven forward in projectile 10 and the threads of nuts 82 are stripped. Plate 64 is then ejected by spring 74 and the fiber can now pay-out from the entire open aft end of the projectile 10.

It will be apparent to those skilled in the art that various modifications or variations could be made of the projectile system of the invention without departing from the scope or spirit of the invention.

What is claimed is:

1. A tube-launched projectile having an open aft end of predetermined diameter containing a bobbin, the projectile including an aft closure, the aft closure comprising:

means for protecting the bobbin including a rigid and solid aft closure plate having a diameter no greater than the predetermined diameter and sized to seal the open aft end of the tube-launched projectile;

attaching means for connecting said aft closure plate to the aft end of the tube-launched projectile, wherein said aft closure plate and said attaching means act together to protect the interior of the tube-launched projectile from the force of expanding launch gases; and detaching means for releasing said attaching means after launch of the tube-launched projectile.

2. The aft closure as recited in claim 1, further comprising ejecting means for jettisoning said aft closure plate after release by said releasing means.

3. The aft closure as recited in claim 2, wherein said ejecting means comprises a spring.

4. The aft closure as recited in claim 1, further comprising a sting attached to said aft closure plate.

5. The aft closure as recited in claim 1, wherein said attaching means comprises multiple shear pins passing through said aft end of said tube launch projectile and into said aft closure plate.

6. The aft closure as recited in claim 5, wherein said detaching means comprises sliding means for allowing movement of said aft closure plate under pressure from said launch gases so that said shear pins shear.

7. The aft closure as recited in claim 6, wherein said sliding means comprises a recess in said aft end of said tube-launched projectile adapted to allow movement of said aft closure plate into said recess so that said shear pins shear.

8. A tube-launched projectile having an aft end, the projectile including an aft closure, the aft closure comprising:

a solid aft closure plate of size sufficient to seal the aft end of the tube-launched projectile;

multiple bolts attached to said aft end of said tube-launch projectile and passing through said aft closure plate, and nuts threaded onto said bolts, for connecting said aft closure plate to the aft end of the tube-launched projectile, wherein the solid aft closure plate, the nuts, and the bolts act together to protect the interior of the tube-launched projectile from the force of expanding launch gases;

stripping means for stripping said bolts from said nuts; and controller means for activating said stripping means.

9. The aft closure as recited in claim 8, wherein said stripping means comprises a pyrotechnic charge; and electrical connection means for transmitting an electrical pulse from said controller means to said pyrotechnic charge whereby said pyrotechnic charge may be ignited.

* * * * *